US009057240B2

(12) United States Patent
Smith et al.

(10) Patent No.: US 9,057,240 B2
(45) Date of Patent: Jun. 16, 2015

(54) DEBRIS BARRIER FOR DOWNHOLE TOOLS

(75) Inventors: Steven B. Smith, Katy, TX (US); Mark S. Fuller, Montgomery, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 691 days.

(21) Appl. No.: 12/617,539

(22) Filed: Nov. 12, 2009

(65) Prior Publication Data

US 2011/0108266 A1 May 12, 2011

(51) Int. Cl.

| | |
|---|---|
| ***E21B 23/00*** | (2006.01) |
| ***E21B 33/04*** | (2006.01) |
| ***E21B 23/06*** | (2006.01) |
| ***E21B 43/10*** | (2006.01) |

(52) U.S. Cl.

CPC ..... *E21B 33/04* (2013.01); *E21B 23/00* (2013.01); *E21B 23/06* (2013.01); *E21B 43/10* (2013.01)

(58) Field of Classification Search

CPC ..... E21B 23/06; E21B 23/00
USPC ..... 166/382
See application file for complete search history.

(56) References Cited

U.S. PATENT DOCUMENTS

| | | | | |
|---|---|---|---|---|
| 3,260,309 | A * | 7/1966 | Brown | 166/124 |
| 4,274,497 | A * | 6/1981 | Willis et al. | 175/100 |
| 5,095,978 | A * | 3/1992 | Akkerman et al. | 166/120 |
| 5,404,955 | A * | 4/1995 | Echols et al. | 166/382 |
| 5,582,253 | A | 12/1996 | Fraser | |
| 5,628,366 | A * | 5/1997 | Telfer | 166/380 |
| 6,065,536 | A * | 5/2000 | Gudmestad et al. | 166/208 |
| 6,230,801 | B1 | 5/2001 | Hill, Jr. et al. | |
| 6,408,945 | B1 * | 6/2002 | Telfer | 166/311 |
| 6,453,996 | B1 | 9/2002 | Carmichael et al. | |
| 7,048,055 | B2 | 5/2006 | Hirth | |
| 7,225,870 | B2 | 6/2007 | Pedersen et al. | |
| 2003/0111236 | A1 * | 6/2003 | Serafin et al. | 166/387 |
| 2003/0132007 | A1 * | 7/2003 | Howlett et al. | 166/387 |
| 2004/0094309 | A1 * | 5/2004 | Maguire | 166/381 |
| 2004/0221984 | A1 | 11/2004 | Cram | |
| 2005/0155775 | A1 * | 7/2005 | Hirth et al. | 166/387 |
| 2008/0060816 | A1 | 3/2008 | Howlett | |
| 2008/0121436 | A1 * | 5/2008 | Slay et al. | 175/371 |

OTHER PUBLICATIONS

Australian Office Action for Patent Application No. 2010241423 dated Dec. 23, 2011.

Floating Junk Bonnet (FJB); Weatherford, Liner Systems; Weatherford International Ltd., © 2006 Weatherford.

Canadian Office Action for Application No. 2,720,443 dated Mar. 29, 2012.

Partial European Search Report; EP Applicaton No. 10190628.7-2315; dated Oct. 15, 2012.

(Continued)

*Primary Examiner* — Shane Bomar
*Assistant Examiner* — Kipp Wallace
(74) *Attorney, Agent, or Firm* — Patterson & Sheridan, LLP

(57) ABSTRACT

A debris barrier assembly for use downhole includes a single body annular barrier having a bore; an extension tubular inserted through the bore; an upper tubular coupled to an upper end of the extension tubular; and a lower tubular coupled to a lower end of the extension tubular, wherein the lower tubular includes a release valve. In one embodiment, the release valve is mechanically opened. In another embodiment, a torque connection is used to couple the upper tubular to the extension tubular.

34 Claims, 8 Drawing Sheets

(56) References Cited

OTHER PUBLICATIONS

Canadian Office Action dated Jun. 25, 2013, Canadian Patent Application No. 2,720,443.

EP Search Report for Application No. EP 10 19 0628 dated Feb. 7, 2013.

EP Extended Search Report for Application No. EP 10190628.7-1610/2322758 dated Feb. 19, 2013.

* cited by examiner

DEBRIS BARRIER FOR DOWNHOLE TOOLS

BACKGROUND OF THE INVENTION

1. Field of the Invention

Embodiments of the present invention generally relate to methods and apparatus for a debris barrier assembly for downhole tools.

2. Description of the Related Art

Wells are typically formed using two or more strings of casing. Generally, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps with the lower portion of the upper string of casing. The second "liner" string is then fixed or "hung" off of the upper surface casing. Afterwards, the liner is also cemented. This process is typically repeated with additional liner strings until the well has been drilled to total depth.

The process of fixing a liner to a string of surface casing or other upper casing string involves the use of a liner hanger and a packer assembly. The liner hanger is typically run into the wellbore above the liner string itself. The liner hanger is actuated once the liner is positioned at the appropriate depth within the wellbore. The liner hanger is typically set through actuation of slips which ride outwardly on cones in order to frictionally engage the surrounding string of casing. The liner hanger operates to suspend the liner from the casing string. The packer assembly is connected above the liner hanger and may be actuated to provide a seal between the liner and the casing. A polished bore receptacle ("PBR") sleeve is connected above the packer assembly to facilitate setting of the packer.

The assembly of liner, liner hanger, and packer assembly are typically run into the well using a running assembly having a running tool, a setting assembly, and a debris barrier. One type of debris barrier is known as a junk bonnet. The running assembly is inserted into the PBR sleeve and the liner. The running tool is actuated to releasably retain the liner assembly. The setting assembly is positioned above the running tool and includes a plurality of spring-loaded dogs. The debris barrier is connected above the setting assembly and proximate an upper portion of the PBR sleeve. The debris barrier is intended to prevent debris from entering the PBR sleeve, such as during the cementing process. After actuating the liner hanger, the packer is set by lifting the setting assembly above the PBR sleeve to allow the spring loaded dogs to spring radially outward. Thereafter, the dogs are urged against the top end of the PBR sleeve to apply an axial force downward to set the packer.

While lifting the setting assembly out of the PBR sleeve, the top end of the debris barrier is also lifted out of the PBR sleeve. Without the debris barrier plugging the PBR sleeve, the top end of the PBR sleeve is opened to the wellbore. Debris is thus allowed to enter the PBR sleeve. The debris may disrupt the performance of the operation by entering the tool assemblies or fluid passages.

There is a need, therefore, for a debris barrier adapted to prevent debris to enter the PBR sleeve or other tools during the liner installation process.

SUMMARY OF THE INVENTION

Embodiments of the present invention relate to a debris barrier assembly. The debris barrier assembly includes a single body annular barrier having a bore; an extension tubular inserted through the bore; an upper tubular coupled to an upper end of the extension tubular; and a lower tubular coupled to a lower end of the extension tubular, wherein the lower tubular includes a release valve.

In one embodiment, a debris barrier assembly includes an annular barrier having a bore; an extension tubular inserted through the bore; a first tubular threadedly connected to a first end of the extension tubular; a torque connection for connecting the first tubular to the first end; and a second tubular coupled to a second end of the extension tubular, wherein the second tubular includes a release valve. In another embodiment, a torque connection is used to connect the second tubular to the extension tubular. In a further embodiment, the torque connection may be used to transfer torque in either rotational direction.

In another embodiment, a downhole tool assembly includes a tubular housing; an annular barrier having a bore; an extension tubular inserted through the bore; an upper tubular coupled to an upper end of the extension tubular; and a lower tubular coupled to a lower end of the extension tubular, wherein the lower tubular includes a release valve, and an annular space formed below the annular barrier, wherein a volume of the annular space remains substantially constant when the lower tubular is moved relative to the annular barrier.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 9A shows the release valve in the closed position. FIG. 9B shows the release valve in the partially open position. FIG. 9C shows the release valve in the fully open position.

DETAILED DESCRIPTION OF THE PREFERRED EMBODIMENT

Embodiments of the present invention generally relate to methods and apparatus for preventing debris from entering a downhole tool such as a PBR sleeve. In one embodiment, a debris barrier assembly includes an annular debris bonnet disposed on an extension tube. The annular debris bonnet may be a single piece annular body having a bore therethrough for receiving the extension tube.

Embodiments of the invention are described below with terms designating orientation in reference to a vertical wellbore. These terms designating orientation should not be deemed to limit the scope of the invention. Embodiments of the invention may also be used in a non-vertical wellbore, such as a horizontal wellbore.

Figure 1A:
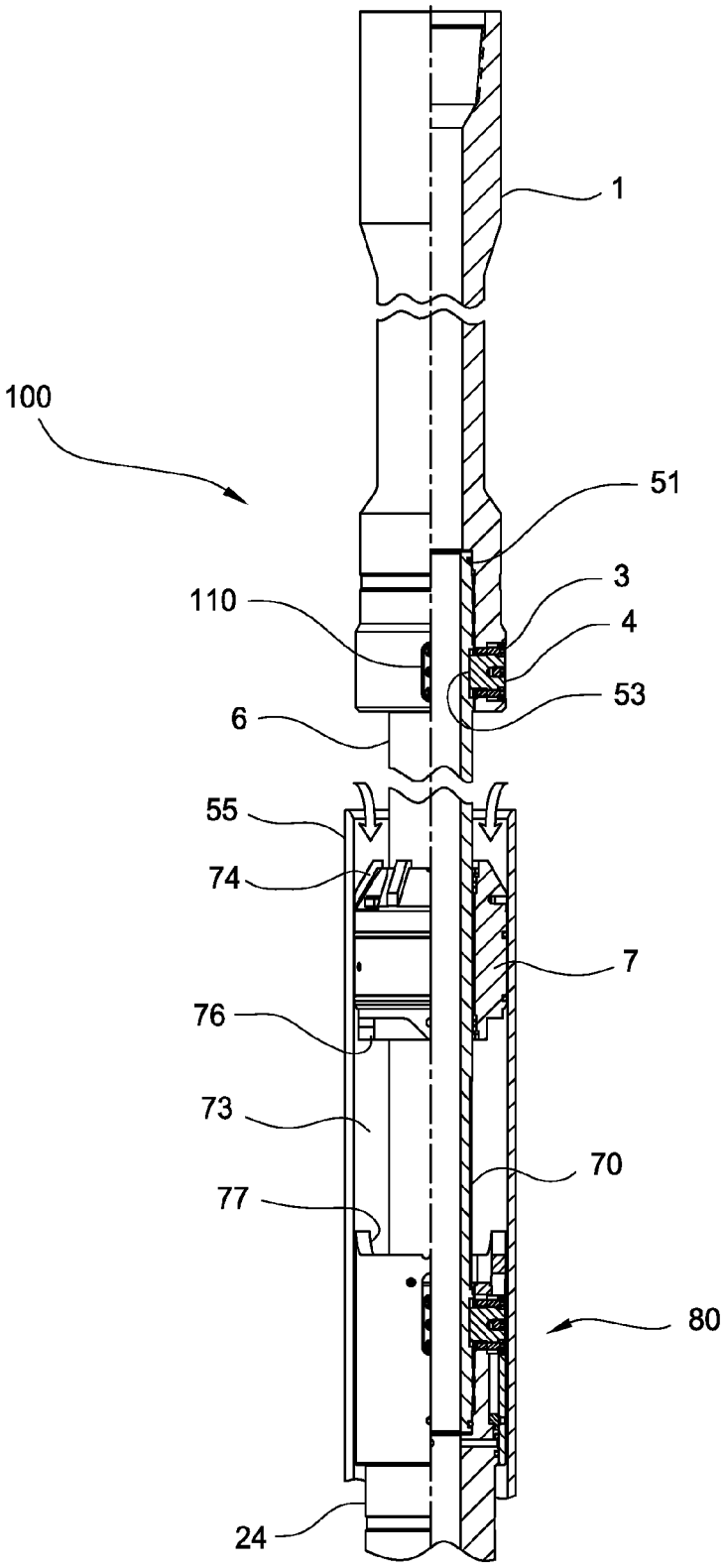
FIGS. 1A-1B are schematic partial cross-sectional views of one embodiment of a debris barrier assembly.
Figure 1B:
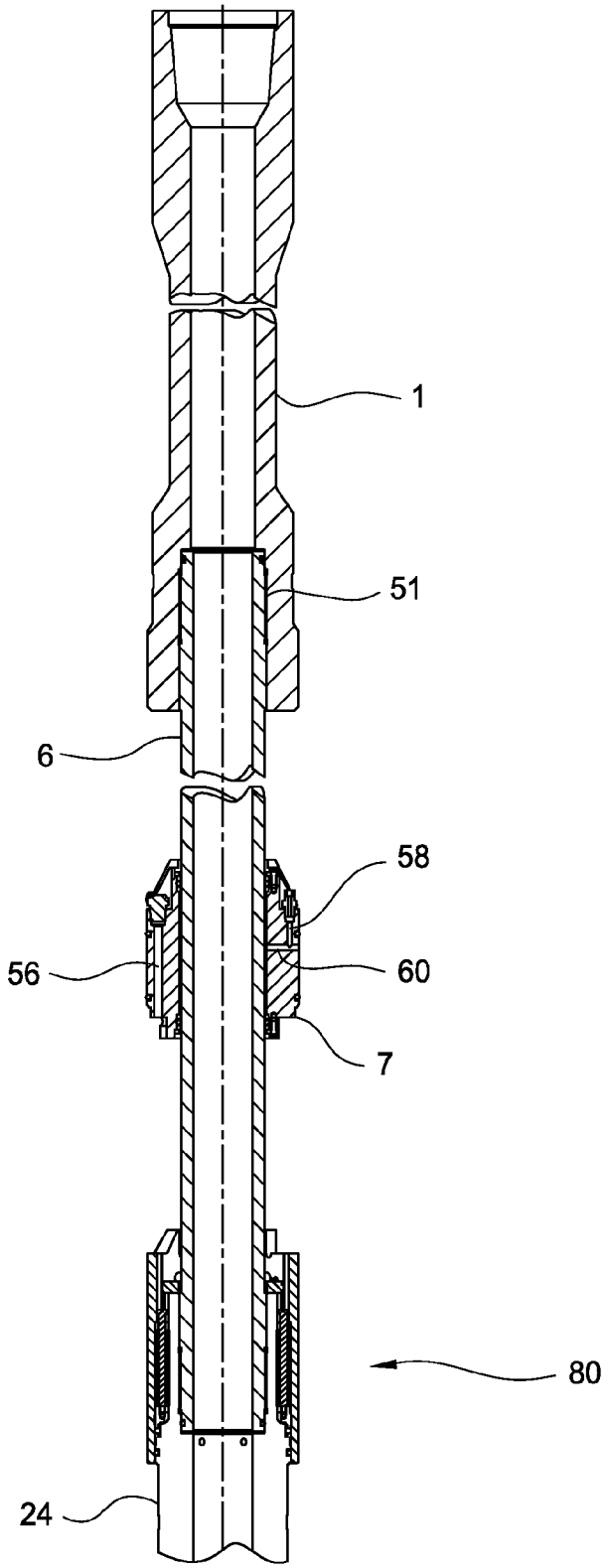

FIGS. 1A-1B are partial cross-sectional views of an exemplary embodiment of a debris barrier assembly 100. FIG. 1B is a cross-sectional view of the debris barrier assembly 100 rotated 45 degrees from the view of FIG. 1A. The barrier assembly 100 is shown disposed in a polished bore receptacle ("PBR") sleeve 55. The barrier assembly 100 includes a lift sub 1 and a lower body 24 threadedly connected to opposite ends of an extension tube 6. Although not shown, the lower end of the lower body 24 may be fitted with threads for connection to another downhole tool, such as a packer setting assembly and/or a running tool.

In addition to threads, the lift sub 1 is also connected to the extension tube 6 using a torque connection 110. The torque connection 110 allows torque to be transferred from the lift sub 1 to the extension tube 6 and vice versa without the torque forces acting on the threads 51. Additionally, the torque connection 110 may allow torque to be transferred in either rotational direction. In one embodiment, the torque connection 110 includes a torque key 4 inserted radially through the lift sub 1 to mate with a recess 53 in the extension tube 6. As shown, the torque key 4 has an elongated T-shaped profile formed by a key section and a head section. The head section has flanges extending beyond the key section. The lift sub 1 has a mating slot extending through its wall for receiving the torque key 4. The mating slot may have a shoulder for engaging the flanges of the head section to limit inward radial movement of the torque key 4. Screws 3 may be inserted through the flanges to attach the torque key 4 to the lift sub 1. The torque key 4 is designed such that a portion of the key section protrudes radially inwardly from the lift sub 1 after attachment. The protrusion mates with a mating recess 53 formed on the outer surface of the extension tube 6. In this respect, torque applied to the lift sub 1 may be transmitted from the torque key 4 to the extension tube 6. As shown, four torque keys are arranged at about 90 degrees apart. It is contemplated that any suitable number of torque keys such as one, two, three, or more may be used or arranged circumferentially at any suitable spacing.

The barrier assembly 100 also includes a debris bonnet 7 slidably disposed on the extension tube 6. The extension tube 6 has a smaller outer diameter than the lift sub 1. The extension tube 6 can be disconnected from the lift sub 1 for insertion through the debris bonnet 7. In one embodiment, the debris bonnet 7 is a one-piece ring shaped body. The extension tube 6 can be inserted through the central bore of the bonnet 7. Thereafter, the extension tube 6 is threadedly connected to the lift sub 1 and the torque keys 4 are attached to complete the torque connection 110. The one-piece debris bonnet 7 reduces the potential for leakage when compared to a bonnet whose annular body is formed by connecting a plurality of arcuate pieces, such as a two piece semi-annular bonnet assembly.

Figure 2A:
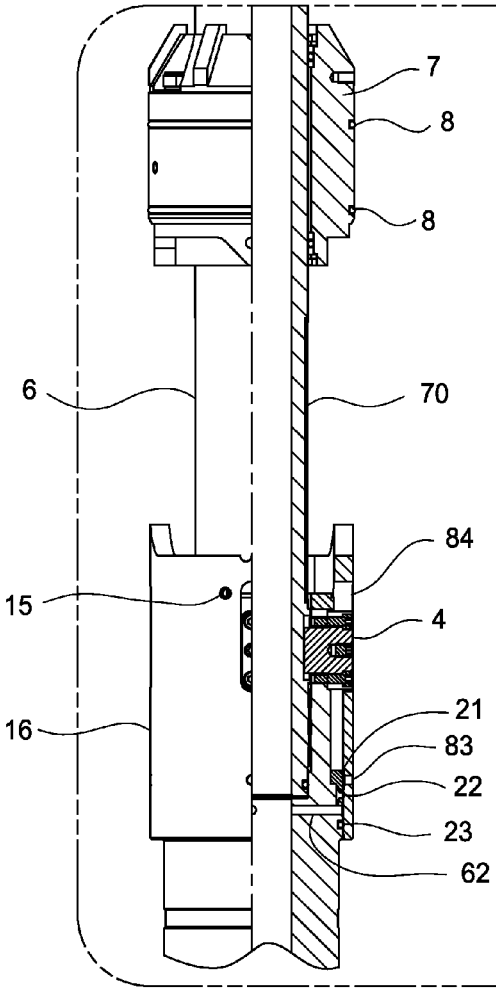
FIGS. 2A-B are exploded partial cross-sectional views of the debris barrier assembly of FIG. 1.
Figure 2B:
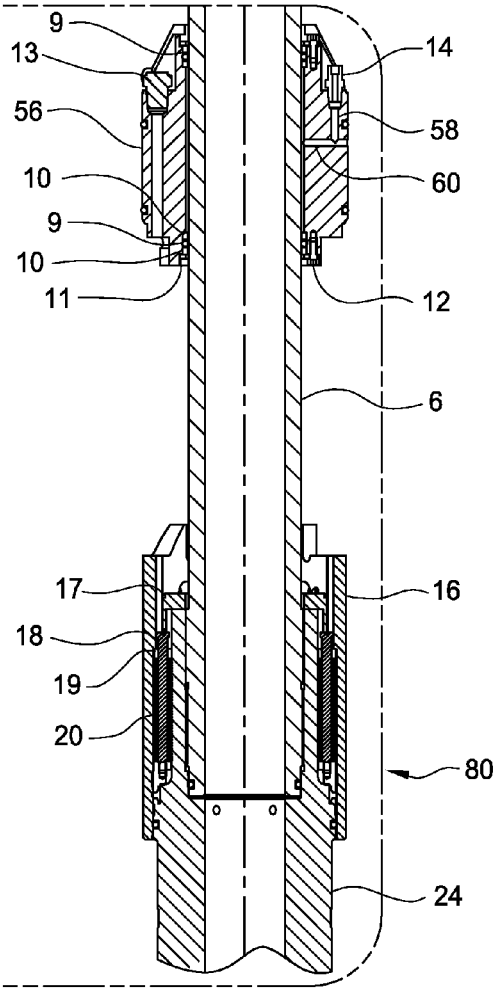

FIGS. 2A-2B are exploded partial views of FIGS. 1A-1B. The outer surface of the debris bonnet 7 is provided with an upper outer seal 8 and a lower outer seal 8. Suitable seals include an elastomeric o-ring. The outer seals 8 may be mounted in a respective circumferential slot extending around the outer surface of the debris bonnet 7. The outer seals 8 are adapted to sealingly engage the inner surface of the PBR sleeve 55. Although two outer seals are shown, one or more seals may be used.

The inner surface of the debris bonnet 7 is provided with an upper inner seal 9 and a lower inner seal 9. In one embodiment, each inner seal 9 is optionally placed between two split rings 10. A seal retainer 11 may be used to retain the seal 9 and rings 10 in position. The seal retainer 11 is attached to the bonnet 7 using a screw, or other suitable fastener. The inner seals 9 form a sliding seal with the outer surface of the extension tube 6. A longitudinal passage 56 extends from the upper end to the lower end of the debris bonnet 7. The longitudinal passage 56 may be used to supply fluid to below the debris bonnet 7. A plug 13 may be used to selectively block the passage 56. A second longitudinal passage 58 extends from the upper end of the debris bonnet 7 to a transverse passage 60. The transverse passage 60 extends from the inner surface between the inner seals 9 to the outer surface between the outer seals 8. A second plug 14 may be used to selectively block the second passage 58.

A bypass slot 70 is formed on the outer surface of the extension tube 6 below the debris bonnet 7. The bypass slot 70 is configured to remain below the debris bonnet 7 during set up, running operations, and cementing operations. The bypass slot 70 may be used to facilitate the release of the debris bonnet 7. As will be discussed in more detail below, debris bonnet 7 may be hydraulically locked in place. To release the bonnet 7, the lift sub 1 may be lifted such that the extension tube 6 and the bypass slot 70 move relative to the debris bonnet 7 to the extent that a portion of the slot 70 moves past the upper inner seal 9, thereby breaking the hydraulic lock on the bonnet 7.

The debris barrier assembly 100 may optionally include a backup release valve assembly 80. Referring to FIGS. 2A-2B, the lower body 24 is connected to the extension tube 6 using another torque connection 110 as described above. As illustrated, the lower body 24 includes a radial channel 62 in communication with the bore of the extension tube 24. Seals 22, 23 are placed on each side of the channel 62 for sealing engagement with a valve sleeve 16. In one embodiment, the lower seal 23 is an o-ring. The upper seal 22 is a T-seal. One side of the T-seal may be retained by a shoulder formed on the lower body 24. A retainer ring 21 may be positioned on the other side of the T-seal to retain the T-seal in cooperation with the shoulder. The retainer ring 21 is supported by a pin 18 having one end abutting the retainer ring 21 and an opposite end abutting a retention flange 17. The retention flange 17 is an annular shaped ring mounted to the upper end of the lower body 24. A biasing member such as a spring 20 is disposed around the pin 18 and is biased between the retainer ring 21 and a spring bushing 19. It must be noted that the upper seal may an o-ring seal, a cap seal assembly, a positively retained seal, or other suitable sealing members know to a person of ordinary skill in the art.

The valve sleeve 16 is disposed around the exterior of the lower body 24. The lower end of the valve sleeve 16 sealingly engages the seals 22, 23 around the channel 62. The valve sleeve 16 selectively movable relative to the lower body 24 to align the channel 62 with a port 83 in the valve sleeve 16. The valve sleeve 16 is initially prevented from axial movement by one or more shearable members such as shear screws 15. The inner surface of the valve sleeve 16 has a longitudinal arcuate recess profile for accommodating the curvature of the spring 20 and the bushing 19. The bushing 19 is axially biased against the upper end of the recess profile. The valve sleeve 16 also includes elongated windows 84 to allow placement of the torque keys 4. The windows 84 are longer than the torque keys 4 to allow for relative axial movement of the torque keys 4 to the windows 84.

Figure 3:
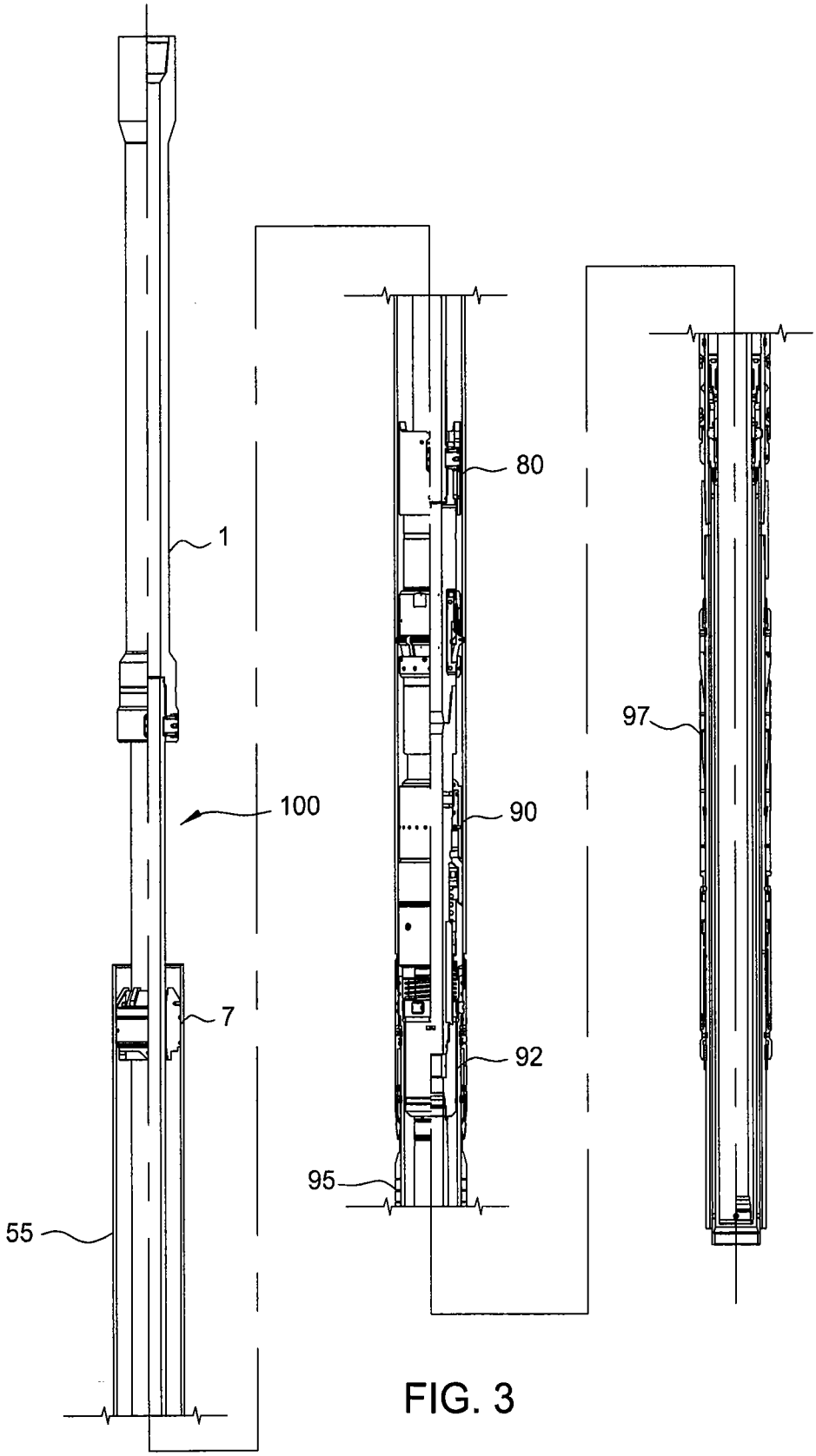
FIG. 3 shows an embodiment of a debris barrier assembly connected to a tool string for performing a cementing operation.

The debris barrier assembly 100 is assembled with other tools to the liner prior to run-in. FIG. 3 shows an embodiment of the debris barrier assembly 100 connected to a plurality of tools for use in a cementing operation. The debris barrier assembly 100 may be connected to a running tool 90 and a retrievable seal mandreal 92. The liner assembly having a liner hanger 97, a packer assembly 95, and PBR sleeve 55 may be assembled in any suitable manner known to a person of ordinary skill in the art. The debris barrier assembly 100 and the connected components are then inserted into the liner assembly and attached to a conveyance tool such as drill pipe.

After insertion, an annular space is defined by the exterior surface of the extension tube 6, the inner surface of the PBR 55, the retrievable seal mandrel 92, and the upper bonnet 7. A portion of the annular space 73 is shown in FIG. 1A. The annular space 73 may be filled with a fluid such as oil by removing the plug 13 from the longitudinal passage 56. The extension tube 6 may move axially relative to the bonnet 7 and the retrievable seal mandreal 92 without substantially changing the volume of the annular space. Thus, the debris bonnet 7 is hydraulically locked in its position without reliance on any mechanical fastening. As a result, the debris bonnet 7 is allowed to "float" on the filling fluid inside the PBR 7 during operations.

Figure 4:
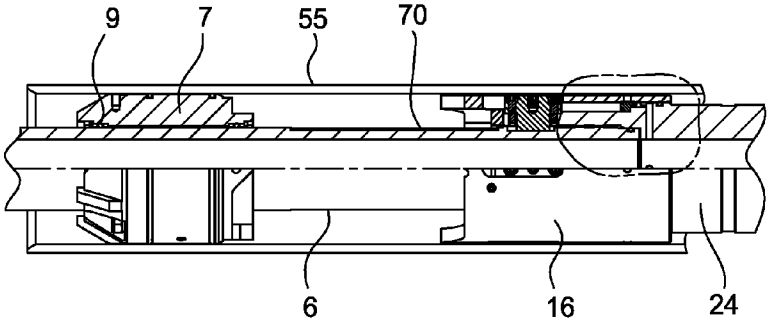
FIGS. 4-6 are partial cross-sectional views of sequential operations of releasing the debris barrier assembly.
Figure 5:
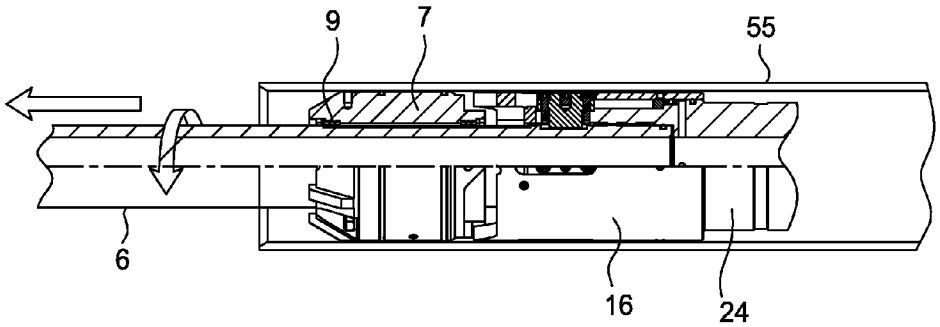
Figure 6:
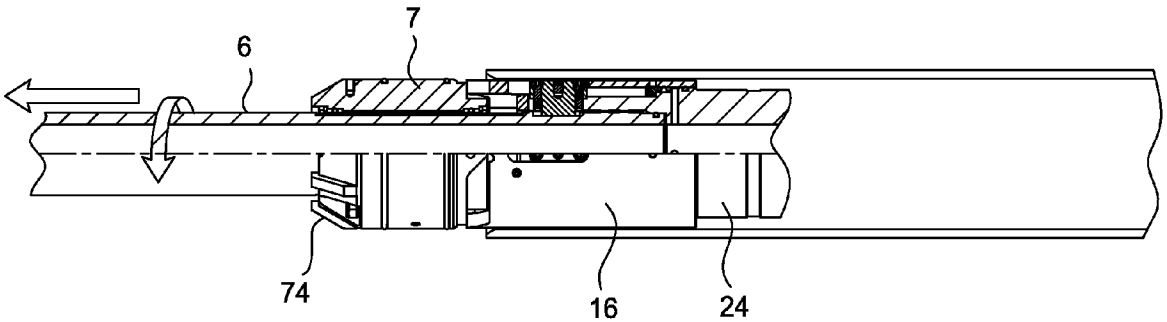

After locating the debris barrier assembly 100 in the wellbore and the liner cementing operation has been performed, the debris bonnet 7 can be released and retrieved with the setting and running tools. Referring now to FIGS. 4-6, to release the debris bonnet 7, the lift sub 1 is raised, thereby pulling the extension tube 6, the bypass slot 70 on the extension tube 6, and the lower body 24 toward the debris bonnet 7. When the bypass slot 70 moves past the upper inner seal 9 as shown in FIG. 5, the hydraulic lock on the bonnet 7 is broken. In one embodiment, the bypass slot 70 is configured to pass the upper inner 9 before the upper end of the valve sleeve 16 comes into contact with the bonnet 7. Thereafter, the extension tube 6 and the lower body 24 is lifted further into engagement with the bonnet 7, which allows the bonnet 7 to be removed with the assembly 100. In FIG. 6, the lower body 24 and the debris bonnet 7 are removed from the PBR sleeve 55.

In some instances, excess debris accumulated on the debris bonnet 7 may block communication through the bypass slot 70 to prevent breakage of the hydraulic lock on the bonnet 7. To resolve this problem, the upper portion of the debris bonnet 7 may include one or more reamer blades 74 while the lower portion includes one or more formations, such as castellations 76 engageable with corresponding formations, such as castellations 77 on the valve sleeve 16, as shown in FIG. 1A. The castellations 76, 77 function as a clutch to allow torque transfer from rotation of the extension tube 6 to the bonnet 7. In this manner, blades 74 of the debris bonnet 7 may be rotated to back ream the excess debris.

Figure 7B:
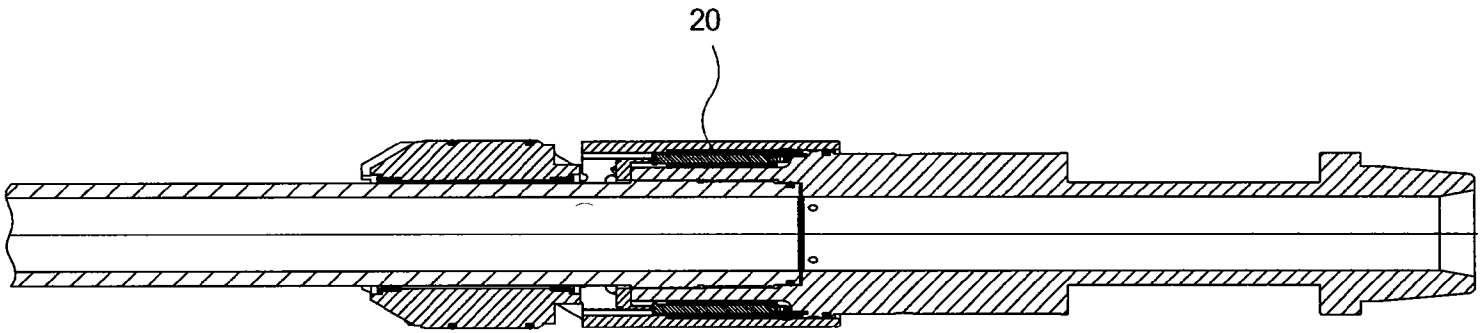
FIGS. 7A-B are partial cross-sectional view of the debris barrier assembly is a lifting position and a release valve is closed.
Figure 7A:
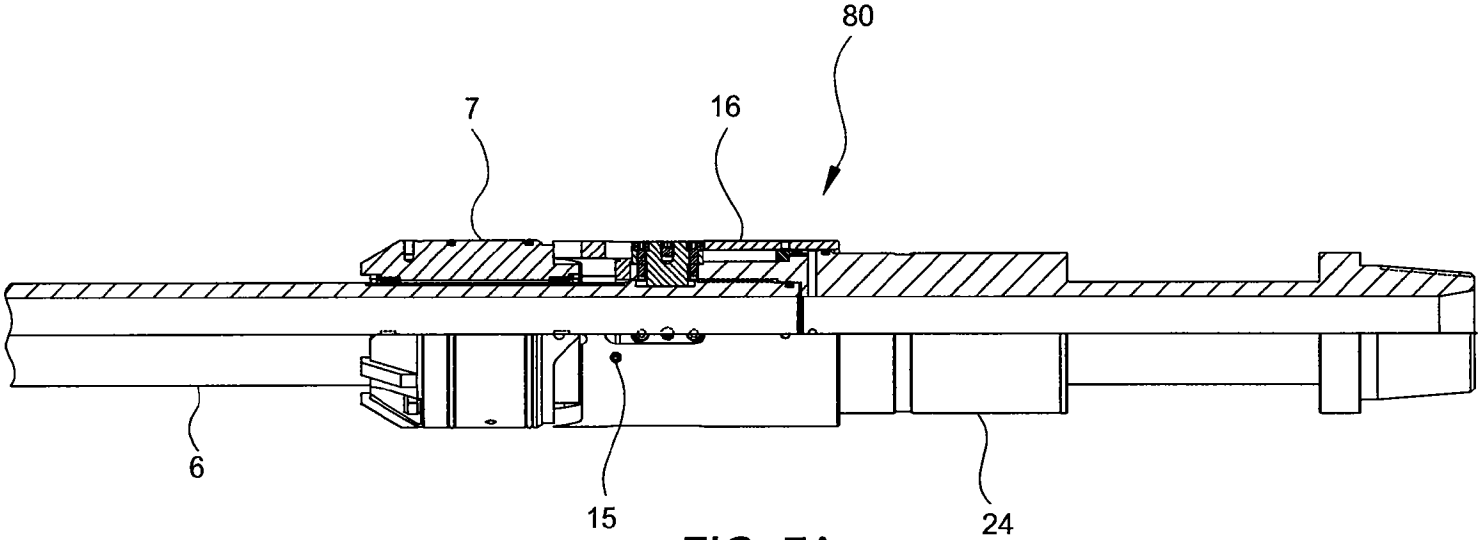
Figure 8B:
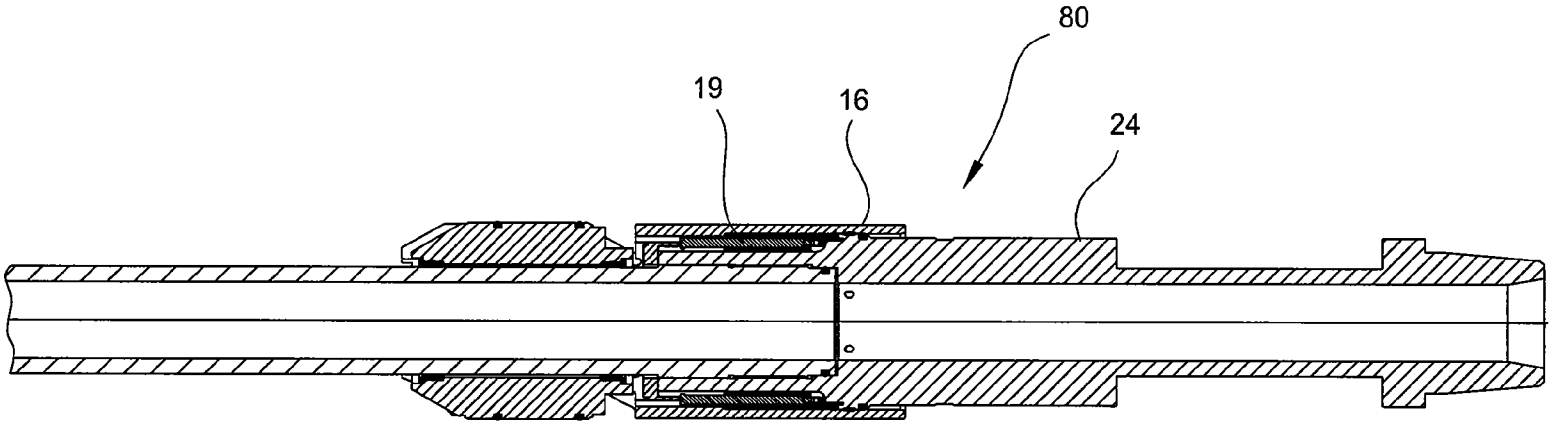
FIGS. 8A-B are partial cross-sectional view of the debris barrier assembly when the release valve is open.
Figure 8A:
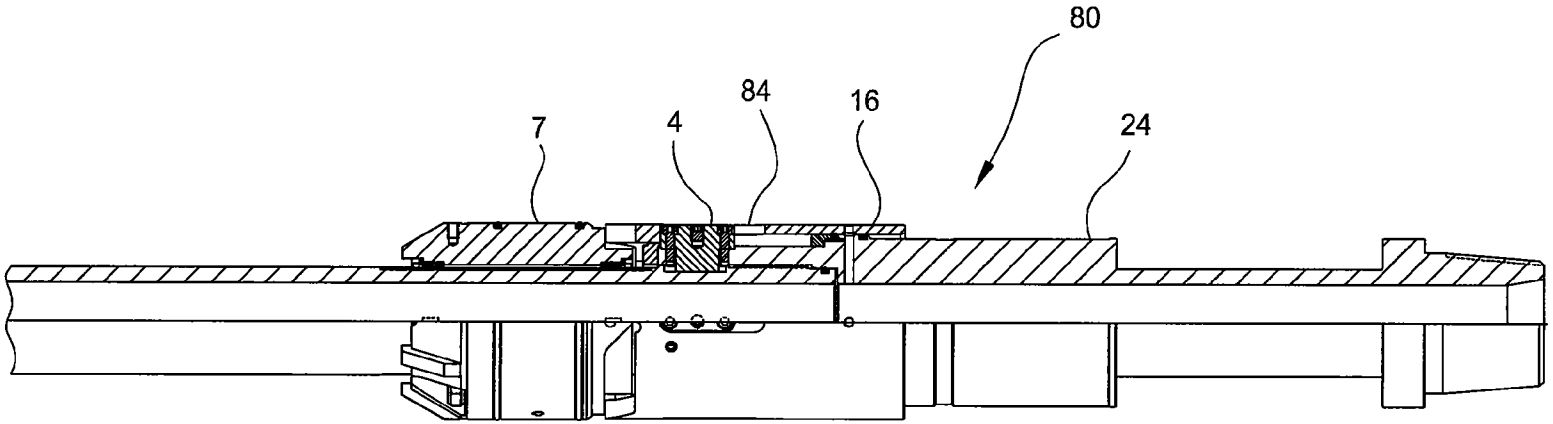
Figure 9A:
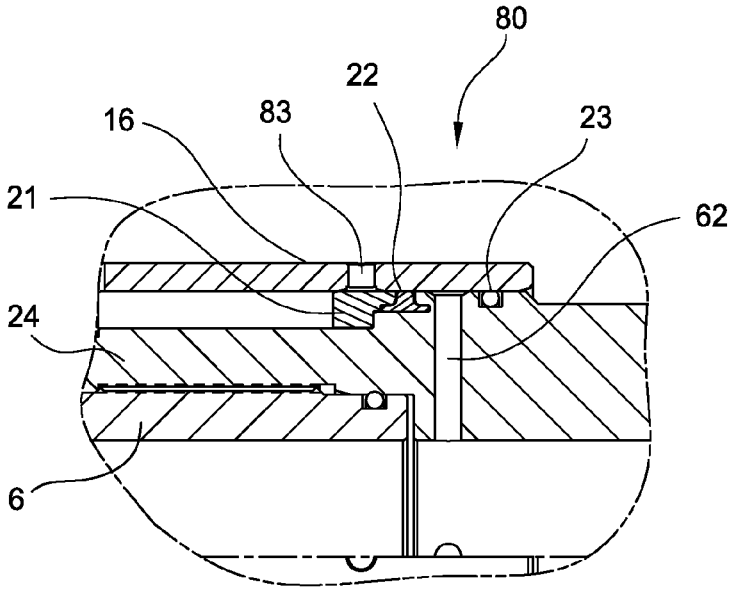
FIGS. 9A-C are exploded partial cross-sectional views of sequential operations of the release valve of the debris barrier assembly.
Figure 9B:
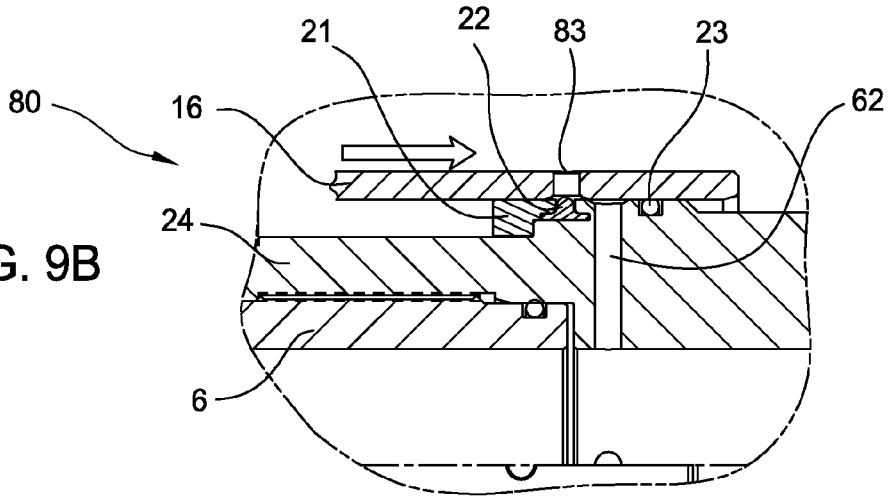
Figure 9C:
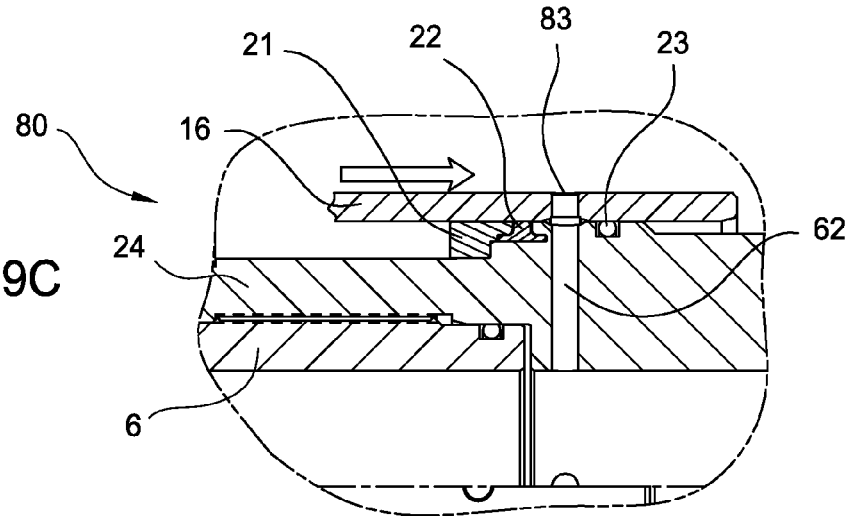

In the event that the bypass slot 70 cannot open, such as due to the blockage of the bypass slot 70 or the inability of the bypass slot 70 to move past the seal 9 on the bonnet 7, the backup release valve 80 may be activated. FIGS. 7-9 show various views of the backup release valve 80 in operation. FIG. 7A shows the release valve 80 just prior to activation and FIG. 7B is a cross section view of debris barrier assembly 100 of FIG. 7A rotated 45 degrees. FIG. 8A shows the release valve 80 in the open position and FIG. 8B is a cross section view of FIG. 8A rotated 45 degrees. FIGS. 9A-C are enlarged partial cross-section views of the sequential operation of the release valve 80.

FIGS. 7A-B show the release valve 80 in the closed position. The release valve 80 has been moved into contact with the bonnet 7 by lifting the extension tube 6. FIG. 9A is an exploded partial view of the release valve in the closed position. In this position, the port 83 of the valve sleeve 16 is not aligned with the channel 62 of the lower body 24. Additionally, the seals 22, 23 straddling the channel 62 prevent communication between the interior and the exterior of the lower body 24.

To open the release valve 80, additional lifting force is applied until the shearable screw 15 is broken, thereby allowing the lower body 24 and the extension tube 6 to move relative to the valve sleeve 16. As the lower body 24 is lifted further, this relative movement causes the spring 20 to compress against spring bushing 19, which is abutted against the valve sleeve 16. In FIG. 9B, the channel 62 has moved closer to the port 83. Also, the upper seal 22 has moved in front of the port 83, thereby disengaging from the sealing contact with the valve sleeve 16. In this respect, fluid communication is established between the channel 62 and the port 83. In this embodiment, because the upper seal 22 has sides which are retained by the shoulder on lower body 24 and the retainer ring 21 (also referred to as "positively retained"), the upper seal 22 is prevented from being washed-out by the fluid flow during opening or closing. FIG. 9C shows the release valve 80 in the fully open position. The channel 62 has moved into alignment with the port 83. The upper seal 22 has re-engaged the valve sleeve 16 and moved away from being directly in the flow path. FIGS. 8A-B also show the release valve 80 in the fully opened position. As shown, the spring 19 has been compressed and the torque keys 4 has moved toward the upper portion of the windows 84 in the valve sleeve 16 as a result of the relative movement between the lower body 24 and the valve sleeve 16. After opening the release valve 80, the hydraulic lock on the bonnet 7 is broken, thereby allowing the debris barrier assembly 100 to be retrieved.

While the foregoing is directed to embodiments of the present invention, other and further embodiments of the invention may be devised without departing from the basic scope thereof, and the scope thereof is determined by the claims that follow.

The invention claimed is:

1. A debris barrier assembly, comprising:

an annular barrier having a bore;

an extension tubular inserted through the bore;

a first release mechanism allowing fluid communication between the annular barrier and the extension tubular for breaking a hydraulic lock on the annular barrier;

an upper tubular coupled to an upper end of the extension tubular;

a lower tubular coupled to a lower end of the extension tubular and including a channel disposed through a sidewall of the lower tubular; and a second release mechanism including a valve sleeve having a port, wherein the lower tubular is selectively moveable relative to the valve sleeve to open fluid communication between the channel and the port, whereby fluid communication through the channel and the port releases the hydraulic lock on the annular barrier.

2. The assembly of claim 1, wherein the upper tubular is coupled to the upper end using a torque connection for transferring torque there between.

3. The assembly of claim 2, wherein the torque connection includes a torque key coupled to the upper tubular and the extension tubular.

4. The assembly of claim 2, wherein the upper tubular is further coupled to the upper end using a thread connection.

5. The assembly of claim 1, further comprising a biasing member disposed between the valve sleeve and the lower tubular.

6. The assembly of claim 1, wherein the lower tubular further includes two seals disposed on each side of the channel and engaged with the valve sleeve.

7. The assembly of claim 5, wherein the channel is sealed from fluid communication with the port in the valve sleeve when the second release mechanism is in a closed position.

8. The assembly of claim 7, wherein the channel fluidly communicates with the port when the second release mechanism is in a open position.

9. The assembly of claim 1, wherein the channel in the lower tubular is sealed from fluid communication with the port in the valve sleeve when the second release mechanism is in a closed position.

10. The assembly of claim 1, wherein the channel fluidly communicates with the port when the second release mechanism is in a open position.

11. The assembly of claim 1, wherein the annular barrier includes a clutch member adapted to engage with a mating clutch member on the lower tubular.

12. The assembly of claim 1, wherein the annular barrier includes a reaming blade.

13. The assembly of claim 1, wherein the first release mechanism comprises a slot formed on an outer surface of the extension tubular.

14. The assembly of claim 1, wherein the annular barrier includes a passageway for conducting fluid extending between a top portion of the annular barrier and a lower portion of the annular barrier.

15. The assembly of claim 1, wherein the extension tubular has a smaller outer diameter than the lower tubular.

16. The assembly of claim 1, wherein one end of the extension tubular is sufficiently sized for insertion through the bore of the annular barrier.

17. The assembly of claim 1, wherein the upper tubular includes a first upset at a first upper tubular end and a second upset at a second upper tubular end.

18. A downhole tool assembly, comprising:

a tubular housing;

an annular barrier having a bore and disposed in the tubular housing;

an extension tubular inserted through the bore;

a first release mechanism allowing fluid communication between the annular barrier and the extension tubular for breaking a hydraulic lock on the annular barrier;

an upper tubular coupled to an upper end of the extension tubular;

a lower tubular coupled to a lower end of the extension tubular and including a channel disposed through a sidewall of the lower tubular;

a second release mechanism including a valve sleeve having a port, wherein the lower tubular is selectively moveable relative to the valve sleeve to open fluid communication between the channel and the port, whereby fluid communication through the channel and the port releases the hydraulic lock on the annular barrier; and an annular space formed below the annular barrier, wherein a volume of the annular space remains substantially constant when the lower tubular is moved relative to the annular barrier.

19. The downhole tool assembly of claim 18, wherein the second release mechanism controls fluid communication between an interior of the extension tube and the annular space.

20. The downhole tool assembly of claim 19, wherein the valve sleeve is releasably attached to the lower tubular.

21. The downhole tool assembly of claim 20, wherein the valve sleeve is biased in a closed position.

22. The downhole tool assembly of claim 20, further comprising a seal member in sealing contact with the lower tubular and the valve sleeve.

23. The downhole tool assembly of claim 22, wherein the seal member is retained by a shoulder on the lower tubular.

24. The downhole tool assembly of claim 18, wherein the upper tubular is coupled to the upper end using a torque connection for transferring torque therebetween, and wherein the torque connection includes a torque key inserted through the upper tubular and the extension tubular.

25. The downhole tool assembly of claim 24, wherein the extension tubular includes a recess for receiving the torque key.

26. The downhole tool assembly of claim 18, wherein the annular space is filled with a liquid.

27. The downhole tool assembly of claim 18, further comprising a torque connection for coupling the upper tubular to the extension tubular.

28. The downhole tool assembly of claim 18, further comprising a running tool connected to the lower tubular.

29. The downhole tool assembly of claim 28, further comprising a seal mandrel coupled to the running tool and the seal mandrel defines a portion of the annular space.

30. The downhole tool assembly of claim 29, further comprising a liner hanger.

31. The downhole tool assembly of claim 22, wherein the seal member is a T-seal that is retained by a shoulder on the lower tubular.

32. A debris barrier assembly, comprising:

an annular barrier having a bore and a passageway for conducting fluid from above the annular barrier to below the annular barrier;

an extension tubular inserted through the bore;

a first tubular threadedly connected to a first end of the extension tubular;

a torque connection for connecting the first tubular to the first end, the torque connection including a torque key inserted radially through the first tubular and a recess in the extension tubular for mating with the torque key, the torque connection allowing torque applied to the first tubular to be transmitted from the torque key to the extension tubular; and a second tubular coupled to a second end of the extension tubular, wherein the second tubular includes a channel disposed through a sidewall of the second tubular, and a valve sleeve releasably coupled to the second tubular and having a port, wherein the second tubular is selectively moveable relative to the valve sleeve to open fluid communication between the channel and the port, whereby fluid communication through the channel and the port releases a hydraulic lock on the annular barrier.

33. The debris barrier assembly of claim 32, wherein the annular barrier is slidable relative to the extension tube.

34. The debris barrier assembly of claim 32, wherein the extension tubular includes a slot that acts as a primary release mechanism for breaking a hydraulic lock on the annular barrier.

* * * * *